US005265754A

United States Patent [19]

Dalbo

[11] Patent Number: 5,265,754

[45] Date of Patent: Nov. 30, 1993

[54] CONTAINER FOR BEADS AND THE LIKE

[75] Inventor: Emil J. Dalbo, Tucker, Ga.

[73] Assignee: Dal-Craft, Inc., Tucker, Ga.

[21] Appl. No.: 2,206

[22] Filed: Jan. 8, 1993

[51] Int. Cl.[5] ..... B65D 1/24

[52] U.S. Cl. ..... 220/524; 220/507; 220/555; 220/509; 220/511

[58] Field of Search ..... 206/821, 511, 509, 503; 220/507, 524, 555, 236, 23.83, 23.86

[56] References Cited

U.S. PATENT DOCUMENTS

| | | | |
|---|---|---|---|
| 4,253,572 | 3/1981 | Halbich | 220/524 |
| 4,599,314 | 7/1986 | Shami | 206/511 |
| 4,895,256 | 1/1990 | Johnston | 206/509 |
| 4,901,846 | 2/1990 | Lehman | 206/821 |
| 5,007,552 | 4/1991 | Sage et al. | 220/23.83 |
| 5,085,342 | 2/1992 | Strawder | 220/524 |
| 5,137,146 | 8/1992 | Stonehouse | 206/509 |
| 5,174,468 | 12/1992 | Holderman | 220/909 |
| 5,184,744 | 2/1993 | Paulison | 220/236 |

FOREIGN PATENT DOCUMENTS

| | | | |
|---|---|---|---|
| 1553925 | 1/1969 | France | 220/507 |

*Primary Examiner*—Allan N. Shoap
*Assistant Examiner*—S. Castellano
*Attorney, Agent, or Firm*—James B. Middleton

[57] ABSTRACT

A container for beads and the like has a body connecting a group of individual compartments. Each compartment is relatively shallow for providing easy access to the contents; and, the bottom of each compartment is sloped so beads will move towards the wall of the compartment, and the bottom is concave so it will not be scratched when resting on surfaces. The container has a plurality of alignment posts to facilitate stacking of containers. The compartments have separate, individually removable, lids so any number of selected compartments can be uncovered for use while the rest remain covered for safety. The compartments are uniformly spaced so a plurality of compartments can be uncovered simultaneously, and beads in a plurality of compartments poured from one container to another.

13 Claims, 2 Drawing Sheets

CONTAINER FOR BEADS AND THE LIKE

BACKGROUND OF THE INVENTION

1. Field of the Invention

This invention relates generally to containers for needlecraft items, and is more particularly concerned with a container for storing a plurality of small objects for easy retrieval by a needleworker.

2. Discussion of the Prior Art

People engaged in needlecrafts frequently utilize small objects such as beads, sequins and other baubles to decorate the needle work. Also, those who make jewelry utilize the same or similar objects, either in making the jewelry or in enhancing the jewelry. The beads, sequins and similar objects are quite small and difficult to work with; and, such objects are especially difficult to retrieve from a container in a position such that a needle can be inserted therethrough. If beads, for example, are placed on a flat surface, or in a very large flat dish, the beads quickly become so dispersed as to be difficult to use. On the other hand, if the beads are retained in a small bag or container, the beads are extremely difficult to place on a needle for use. A distinct hazard in using beads and the like for decoration is that the beads are so small that different colors can easily become intermingled; and, once beads have been spilled from their containers they are difficult to pick up and sometimes must be picked up by means of a vacuum cleaner or the like rather than retrieved for use.

Prior art apparatus for storing beads for use has included the use of small, individual plastic bags having a zipper type closure thereon. While such a bag will obviously hold the beads, the bag is very inconvenient for retrieval of the beads one at a time therefrom. Also, due to the nature of the bag, one would be required to seal the bag each time a bead is retrieved therefrom since beads will spill from the bag if the bag is laid down unclosed. Other prior art containers have multiple compartments, and a single lid to cover all compartments. This arrangement renders the device difficult to use, and especially difficult to transfer beads from one container to another. The prior art further includes the use of individual jars for storage of beads. It will be recognized that a large number of jars will be difficult to keep up with, and very difficult to work from when doing a particular project. Thus, some prior art containers are sophisticated and are extremely complex so they are truly impracticable to use with needlecrafts, and some have been very simple and have not solved the above stated problems.

SUMMARY OF THE INVENTION

The present invention provides a unitary container for beads or the like, the container comprising a plurality of separate compartments or cups, each compartment having a separate lid that can be individually applied or removed. Thus, if a person is working with one type of bead, a single compartment can be uncovered and used; and, if a person is working with two or more different beads, the plurality of compartments can be opened for ready use while the remaining compartments are closed. The container of the present invention further includes stacking means to allow a person to utilize a plurality of containers of the present invention in order to store all the beads the person wishes to use, and the plurality of containers can be stacked securely.

Each individual container is readily retrievable from the stack. Each compartment in each container can be readily identified by label means. Furthermore, the containers may be substantially transparent so that the contents can be identified visually, through the container.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figure 1:
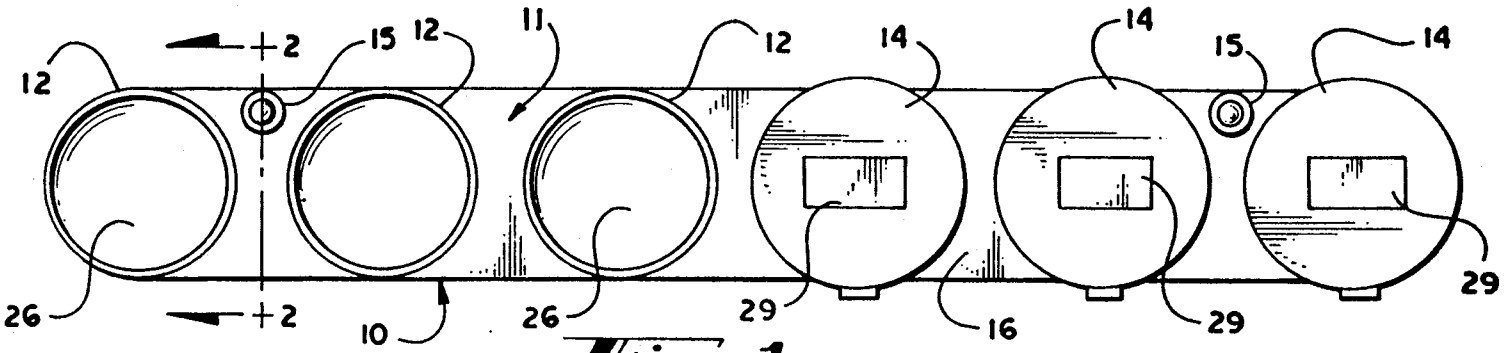
FIG. 1 is a top plan view of a container made in accordance with the present invention, part of the compartments therein having lids, and part being open.

Referring now more particularly to the drawings, and to those embodiments of the invention here presented by way of illustration, the container shown in FIG. 1 is generally designated at 10 and includes a body designated at 11 having a plurality of compartments 12 fixed thereto. All of the compartments 12 are substantially identical so all carry the same reference numeral; however, as shown in FIG. 1, the three compartments 12 at the left-hand end of the figure are without lids, and the three compartments at the right-hand end of the figure have lids thereon. In FIG. 1, the lids 14 completely cover the compartments 12, so only three compartments 12 are seen, while three lids 14 are seen.

Thus, the container 10 of the present invention comprises a unitary device wherein a plurality of compartments 12 is fixed to a body 11. Only the lids 14 are separable therefrom. It will also be noted in FIG. 1 of the drawings that there are alignment means 15 fixed to the body 11. As shown in FIG. 1, there are two of the alignment means 15, both located adjacent to the rear edge of the body 11 and between the end and the penultimate compartments 12. Those skilled in the art will understand that the alignment means 15 can be placed elsewhere as long as they are separated sufficiently to maintain the stacked containers in vertical alignment. As will be discussed in more detail later, the containers 10 can be stacked on top of one another, and the alignment means will hold the several containers in alignment so the containers cannot slide with respect to one another.

Figure 3:
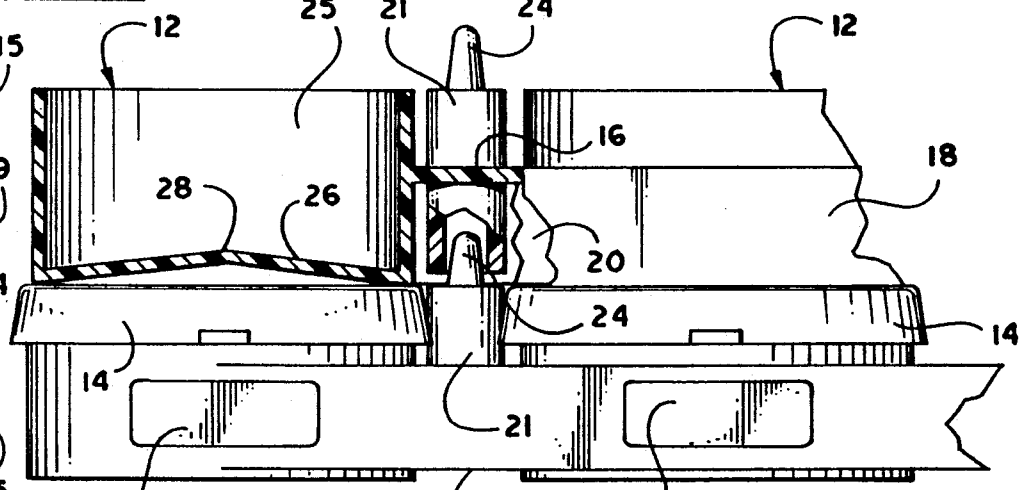
FIG. 3 is a fragmentary front elevational view of the device shown in FIGS. 1 and 2, shown partially in cross-section.
Figure 2:
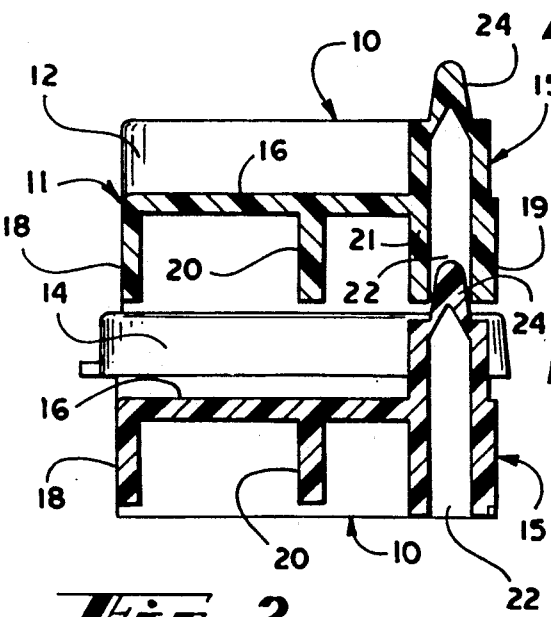
FIG. 2 is an enlarged, cross-sectional view taken generally along the line 2—2 in FIG. 1, showing two containers stacked.

Attention is next directed to FIGS. 2 and 3 of the drawings along with FIG. 1 for a better understanding of the construction of the container 10. It will be noted that, in both FIGS. 2 and 3, there are two containers 10, one stacked on top of the other, with the alignment means 15 engaged to maintain alignment.

Looking especially at FIG. 2, it will be seen that the body 11 includes a platform 16 having front and rear skirts 18 and 19. Generally centrally of the body 11, there is a web 20 that is parallel to the skirts 18 and 19, web 20 being fixed to each of the compartments 12, generally along the centerline of the body 11 and diametrically of the compartments 12. With this configuration, it will be understood that the body 11 is quite strong, and the compartments 12 are fixed to, or formed integrally with, the body 11 so the container 10 is quite rigid.

Alignment means 15 include hollow posts 21 having openings 22 therein. The upper end of each of the posts 21 is a tapered male member 24 appropriately sized to be received within the opening 22 which acts as a female member. The male member 24 extends above the caps 14 so the female member 22 of the upper container 10 will receive the male member 24 of the lower container 10.

It is important to notice that the posts 21 of the alignment means 15 are slightly foreshortened at both the bottom and the top. The lowermost end of the post 21 is just slightly above the bottom of the containers 12, and the upper end of the post 21 is slightly below upper surface of the cap 14. The result of this arrangement is that there is always a small space between the posts 21 of the upper container and the posts 21 of the lower container. This allows some floating of one container with respect to the other so each container is easily stacked on a previous container, even though there may be variations in successive containers.

Especially in FIG. 3 of the drawings, it will be seen that the individual compartment 12 has generally straight sides 25 and a cone shaped bottom 26, the apex 28 of the cone being substantially in the center of a compartment 12. This sloped bottom 26 is useful in that beads in the compartment will tend to roll towards the wall 25. As a result, when there are only a few beads remaining in a compartment 12, the beads will roll against the wall 25 and be easy to capture in the corner of the wall 25 and the bottom 26. While the preferred embodiment of the invention is shown with a conical bottom 26, those skilled in the art will realize that a spherical bottom or other shape will serve the same purpose. The bottom should simply be sufficiently sloped to avoid scratching the bottom and to cause beads to roll against the wall 25.

In this connection it will also be recognized that the proportions of the individual compartments are somewhat important. It should be understood that, if the compartment 12 were narrow and deep, it would be very difficult to retrieve beads or the like from the bottom of the compartment. To facilitate retrieval of beads from the bottom of the compartment 12, it is contemplated that the depth of a compartment 12 will be around half or less of a diameter of the compartment. This provides a workable relationship. Those skilled in the art will understand that the depth of the container can be reduced to the point that only a single layer of beads can be received within the compartment, and the compartment will be usable, though not particularly appropriate for storage. Thus, the compartments may be more shallow than 50% of the diameter of a compartment, but the compartments should not be deeper for general usage. In a prototype of the invention, the depth of a compartment is about 45% of the diameter of a compartment.

Another reason for the sloped bottom 26 in the compartment 12 is also best illustrated in FIG. 3 of the drawings. It is preferable that the bottom 26 and the walls 25 of the individual compartments 12 be transparent, or as nearly so as is reasonably possible. It has been found that the material can be rendered substantially transparent by polishing the mold for making the containers 10, thereby producing a very smooth wall and bottom. So long as the bottom 26 is smooth, the bottom will be substantially transparent; but, if the bottom 26 becomes scratched or otherwise roughened, the bottom 26 will move towards translucence. As is seen in FIG. 3 of the drawings, since the bottom 26 is sloped, only the outside edge of the bottom 26 adjacent to the wall 25 actually contacts the surface on which the container is resting. Thus, the sloped bottom 26 assists in maintaining a transparent bottom.

Those skilled in the art will understand that people who use a variety of beads or the like typically have a supply of a large number of beads of different colors, sizes or the like. For such a supply to be at all usable, it is clear that the individual beads must be labeled by the appropriate characteristic of the bead, and one must be able to find the desired bead at the time it is needed. As is shown in FIGS. 1 and 3, the container 10 of the present invention can be provided with a plurality of labels for ready identification of the particular beads contained in particular compartments 12. FIG. 1 shows labels 29 fixed to the lids 14 of the compartments 12. Even though the lids may be opaque, the beads can be readily identified from the top of the containers if the labels 29 are used.

FIG. 3 indicates a plurality of labels 30 fixed to the front skirt 18 of the container 10. The labels 30 may be important when the lids 14 are removed to allow use of the beads within a particular compartment 12; however, the labels 30 will also be useful to find a particular bead when the container for the bead is in a stack of containers.

Though not here indicated, it will be understood that labels similar to the labels 30 can be placed on the rear skirts 19 of the device shown in FIGS. 1, 2 and 3 if desired.

Figure 4:
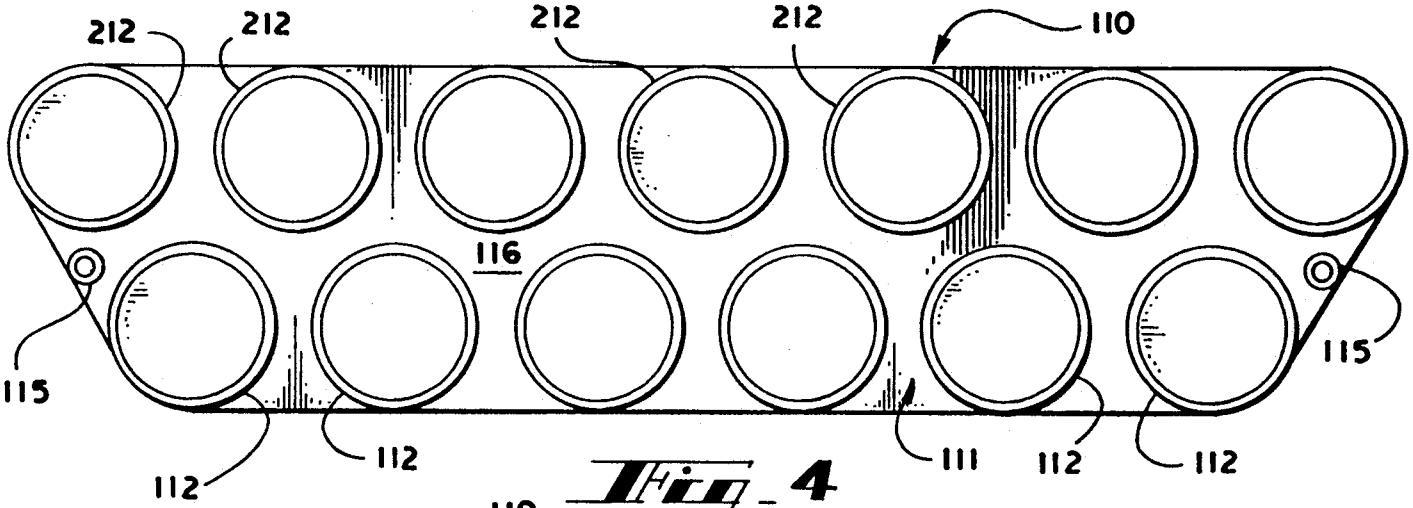
FIG. 4 is a top plan view of a modified form of the device shown in FIG. 1, all of the compartments being without lids; and, FIG. 5 is a bottom plan view of the device shown in FIG. 4.
Figure 5:
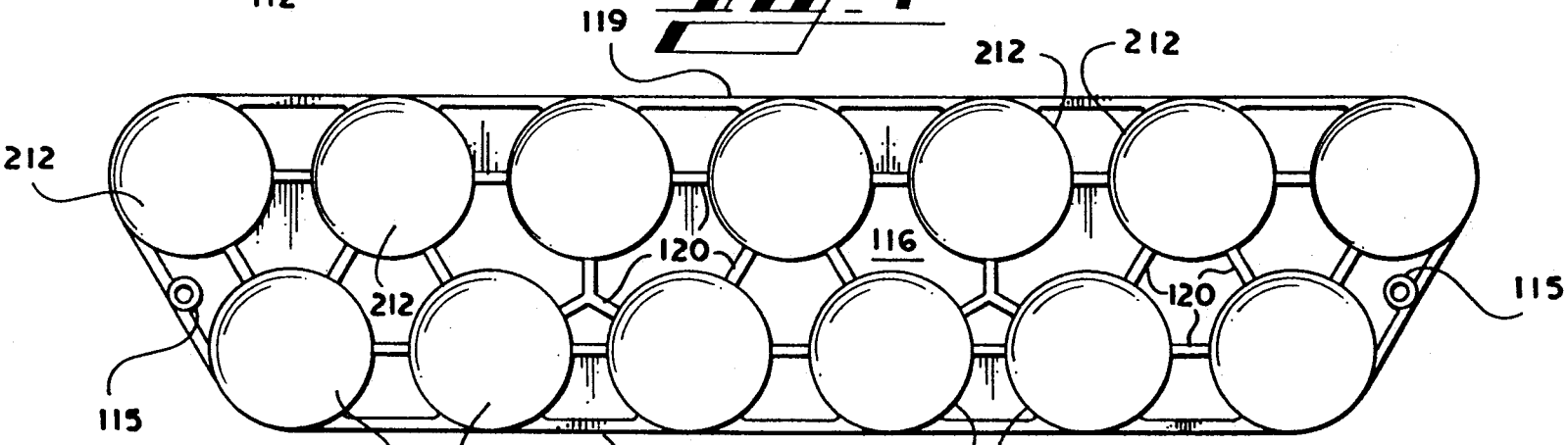

Attention is next directed to FIGS. 4 and 5 of the drawings which show a modified form of the invention disclosed in FIGS. 1–3. In FIG. 4 of the drawings there is a first row of compartments 112, all the compartments 112 being shown without lids. It should be understood that the compartments 112 will be substantially identical to the compartments 12, and lids for the compartments 112 will be used just like the lids 14. While the previously described embodiment of the container of the present invention includes only the six compartments 12 the embodiment shown in FIG. 4 of the drawings includes an additional seven compartments designated at 212. The compartments 112 are laterally spaced from, and centered between, the compartments 212. While no specific dimension is critical, it will be understood that there should be enough space to allow lids such as the lids 14 to be placed on and removed from each of the compartments 112 and 212 without interfering with other compartments.

The embodiment shown in FIG. 4 also includes a body 111, the body 111 including a platform 116, and skirts 118 and 119. Again, the construction is the same as that discussed in connection with FIGS. 1–3, and the detailed construction will not be repeated.

The alignment means 115 in FIG. 4 are placed at the ends of the container 110 but, again, the placement is not critical. So long as the alignment means 115 are sufficiently separated, they could be placed virtually anywhere on the platform 116.

FIG. 5 of the drawings shows the bottom plan view of the device illustrated in FIG. 4. It will here be seen that there is a network of webs 120 interconnecting the various compartments 112 and 212 to provide needed strength. The webs are arranged to prevent both longitudinal bending and warping of the container 110.

In conjunction with the embodiment shown in FIGS. 1-3, it was mentioned that labels such as the label 30 could be placed on both sides of the container 10 if desired. In the embodiment disclosed in FIGS. 4 and 5, it will be seen that labels such as the label 30 will be placed on both sides, labels on the skirt 118 applying to the compartments 112 and labels on the skirt 119 applying to the compartments 212.

The compartments 12, 112 and 212 are equally spaced from one another; and, it is preferable that the individual compartments in each row of compartments be spaced the same. Those skilled in the art will understand that one will sometimes need to transfer beads from one container to another. Since each compartment has its own lid, it will be recognized that one compartment with beads can be opened, and one empty compartment can be opened, and the contents can be poured from one to the other. Further, with equal spacing between all compartments, one can open two or more compartments and pour the contents of multiple compartments at the same time. The multiple compartment pouring can be as many as the six compartments 12 or 112, or the seven compartments 212. Any lesser number can be poured so long as the multiple compartments are in a single line.

It will therefore be seen that the present invention provides a container for beads and the like with the container including a plurality of individual compartments, each individual compartment having a separately removable lid. The result is that only the compartments being immediately used will be uncovered with the rest of the beads secure in case of an accident. Each of the compartments is proportioned to allow easy access to the contents, even when there are only a few left at the very bottom of the compartment. The labeling and stacking means are convenient to use and do not obstruct the intended use of the containers.

It will of course be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. A container for beads, said container comprising a plurality of compartments, each compartment of said plurality of compartments being adapted to receive said beads therein, an elongate body including a platform, a front skirt along one edge of said body and a rear skirt along an opposite edge of said body, said plurality of compartments being fixed to said body and extending upwardly and downwardly from said platform, each compartment of said plurality of compartments having a bottom, said plurality of compartments further being spaced uniformly along said platform, each compartment of said plurality of compartments being adjacent to at least one of said front skirt and said rear skirt, and a separate lid for each compartment of said plurality of compartments, each said separate lid being selectively separable from said container, said compartments being spaced from one another sufficiently that lids on adjacent compartments do not interfere with one another, each compartment of said plurality of compartments being relatively shallow, each bottom being sloped so that the contents of the compartment will tend to move towards the wall of the compartment, each compartment of said plurality of compartments having a diameter, said body having a width generally equal to the said diameter of each compartment of said plurality of compartments, so that said front skirt is tangent to said plurality of compartments, and said rear skirt is tangent to said plurality of compartments.

2. A container as claimed in claim 1, said container being stackable on an identical container, said container including alignment means, said alignment means including a male member extending upwardly from said platform and terminating above said lid on said compartment, and a female member extending downwardly from said platform and terminating above said bottom of said compartment for receiving said male member therein.

3. A container as claimed in claim 1, said bottom being generally conical.

4. A container as claimed in claim 1, and further including labeling means for said plurality of compartments, said labeling means including selectively a first label on said lid and a second label on a skirt.

5. A container for beads, said container comprising a plurality of compartments, each compartment of said plurality of compartments being adapted to receive beads therein, an elongate body including a platform, a front skirt along one edge of said body and a rear skirt along an opposite edge of said body, said plurality of compartments being fixed to said body and extending upwardly and downwardly from said platform, each compartment of said plurality of compartments having a bottom, said plurality of compartments further being spaced uniformly along said platform, each compartment of said plurality of compartments being adjacent to at least one of said front skirt and said rear skirt, and a separate lid for each compartment of said plurality of compartments, each said separate lid being selectively separable from said container, said compartments being spaced from one another sufficiently that lids on adjacent compartments do not interfere with one another, each compartment of said plurality of compartments being relatively shallow, said bottom being sloped so that the contents of the compartment will tend to move towards the wall of the compartment, said front and rear skirts being planar, said plurality of compartments comprising a first row of compartments tangent to said front skirt, and a second row of compartments tangent to said rear skirt, the compartments in said second row of compartments being spaced apart the same as the compartments in said first row of compartments.

6. A container as claimed in claim 5, and further including web means interconnecting the compartments of said plurality of compartments.

7. A container as claimed in claim 1, each compartment of said plurality of compartments having a diameter, and having a depth no more than 50% of the said diameter of such compartment.

8. A container as claimed in claim 7 wherein each compartment of said plurality of compartments has a depth of about 45% of the said diameter of such compartment.

9. A container for beads, said container comprising a plurality of compartments, each compartment of said plurality of compartments being adapted to receive said beads therein, an elongate body including a platform, a front skirt along one edge of said body and a rear skirt along an opposite edge of said body, said plurality of compartments being fixed to said body and extending upwardly and downwardly from said platform, each compartment of said plurality of compartments having a bottom, said plurality of compartments further being spaced uniformly along said platform, each compartment of said plurality of compartments being adjacent to at least one of said front skirt and said rear skirt, and a separate lid for each compartment of said plurality of compartments, each said separate lid being selectively separable from said container, said compartments being spaced from one another sufficiently that lids on adjacent compartments do not interfere with one another, and further including labeling means for said plurality of compartments, said labeling means including selectively a first label on said lid and a second label on a skirt, said front and said rear skirts being planar, said plurality of compartments comprising a first row of compartments tangent to said front skirt, and a second row of compartments tangent to said rear skirt, the compartments in said second row of compartments being spaced apart the same as the compartments in said first row of compartments, and further including a web interconnecting the compartments of said plurality of compartments, said container being stackable on an identical container and including alignment means, said alignment means including a male member extending upwardly from said platform and terminating above said lid on said compartment, and a female member extending downwardly from said platform and terminating above said bottom for receiving said male member therein.

10. A plurality of containers for receiving beads, each container of said plurality of containers comprising an elongate body including a platform, a plurality of compartments spaced along said platform, said plurality of compartments being fixed to said body and extending upwardly and downwardly from said platform and having a top and a bottom, said plurality of compartments of each container being spaced the same so that said compartments are aligned with one another when at least two containers are stacked, a separate lid receivable on said top of each compartment, and alignment means for preventing lateral movement of one container with respect to another container when said containers are stacked, said alignment means including a male member extending upwardly and terminating above said top of said compartments, said a female member extending down and terminating above said bottom of said compartments, said male member on one container of said plurality of containers being received by said female member on a container stacked on said one container, each container of said plurality of containers including at least two of said alignment means, said plurality of compartments extending in a line along said elongate body, each container of said plurality of containers further including a front skirt fixed to said body and tangent to said plurality of compartments, and a rear skirt fixed to said body and tangent to the opposite side of said compartments.

11. A plurality of containers as claimed in claim 10, and further including a plurality of labels, each label of said plurality of labels being fixed to said skirt adjacent to one compartment of said plurality of compartments.

12. A plurality of containers for receiving beads, each container of said plurality of containers comprising an elongate body including a platform, a plurality of compartments spaced along said platform, said plurality of compartments being fixed to said body and extending upwardly and downwardly from said platform and having a top and a bottom, said plurality of compartments of each container being spaced the same so that said compartments are aligned with one another when at least two containers are stacked, a separate lid receivable on said top of each compartment, and alignment means for preventing lateral movement of one container with respect to another container when said containers are stacked, said alignment means including a male member extending upwardly and terminating above said top of said compartments, said a female member extending down and terminating above said bottom of said compartments, said male member on one container of said plurality of containers being received by said female member on a container stacked on said one container, each container of said plurality of containers including at least two of said alignment means, said plurality of compartments comprising a first line of compartments spaced along said elongate body and a second lien spaced along said elongate body parallel to said first line, a first planar skirt fixed to said body and tangent to said first line of compartments, and a second planar skirt fixed to said body and tangent to said second line of compartments.

13. A plurality of containers as claimed in claim 12, and further including a first plurality of labels fixed to said first skirt, and a second plurality of labels fixed to said second skirt, each label being adjacent to one of said plurality of compartments.

* * * * *